US005966762A

United States Patent [19]

Wu

[11] Patent Number: 5,966,762

[45] Date of Patent: Oct. 19, 1999

[54] AIR MATTRESS FOR MODULATING RIDDEN POSITIONS

[76] Inventor: Shan-Chieh Wu, No. 23, Chien- kuo N. Rd., Sec.2, Taipei, Taiwan, 104

[21] Appl. No.: 09/108,586

[22] Filed: Jul. 1, 1998

[51] Int. Cl.[6] ..... A61G 7/00

[52] U.S. Cl. ..... 5/710; 5/615; 5/713; 5/715

[58] Field of Search ..... 5/615, 710, 713, 5/715, 723, 727, 737, 738

[56] References Cited

U.S. PATENT DOCUMENTS

| | | | |
|---|---|---|---|
| 3,392,412 | 7/1968 | Aymar | 5/713 X |
| 3,492,988 | 2/1970 | De Mare | 5/615 X |
| 3,606,623 | 9/1971 | Aymar | 5/615 X |
| 3,667,075 | 6/1972 | Ballard et al. | 5/615 X |
| 3,978,530 | 9/1976 | Amarantos | 5/615 |
| 4,099,276 | 7/1978 | Hunt et al. | 5/615 |
| 4,639,960 | 2/1987 | Quillen et al. | 5/615 X |
| 4,685,163 | 8/1987 | Quillen et al. | 5/710 |
| 4,934,002 | 6/1990 | Watanabe | 5/615 X |
| 4,935,968 | 6/1990 | Hunt et al. | 5/713 |
| 4,941,221 | 7/1990 | Kanzler | 5/615 |
| 4,977,629 | 12/1990 | Jones | 5/715 X |
| 5,181,288 | 1/1993 | Heaton et al. | 5/715 X |
| 5,345,630 | 9/1994 | Healy | 5/615 X |
| 5,794,289 | 8/1998 | Wortman et al. | 5/713 |

FOREIGN PATENT DOCUMENTS

| | | | |
|---|---|---|---|
| 1422606 | 11/1965 | France | 5/615 |
| 3514040 | 10/1986 | Germany | 5/615 |
| 1474018 | 5/1977 | United Kingdom | 5/615 |

*Primary Examiner*—Terry Lee Melius
*Assistant Examiner*—Robert G. Santos

[57] ABSTRACT

An air mattress includes a plurality of inflatable sacs juxtapositionally connected together in a mattress envelope; an air pump for inflating or deflating the sacs for cushioning a patient ridden thereon; a leg bending device consisting of a plurality of inflatable sacs transversely juxtapositioned at a leg section of the mattress envelope and formed as arcuate shape when inflated for cushioning a patient's bending leg; a body turning device consisting of a plurality of inflatable sacs longitudinally juxtapositioned at a right and left side of a torso section and a head section of the mattress envelope, and alternatively inflated and deflated at the right and left sides for turning the patient's body leftwardly and rightwardly; and a head lifting device consisting of a plurality of inflatable sacs gradually decreasing in height from a head portion to a patient's shoulder or neck portion for cushioning the patient's head, thereby forming an air mattress for ergonomically cushioning different body portions of a patient or person.

1 Claim, 7 Drawing Sheets

AIR MATTRESS FOR MODULATING RIDDEN POSITIONS

BACKGROUND OF THE INVENTION

U.S. Pat. No. 4,686,722 to Maarten E. Swart disclosed an articulated bed with cellular air cushion mattress including individual groups of inflatable cushions for forming an air mattress as supplied with pressurizing air through a feed duct and valves.

However, in order for adjusting the height of the carrying plates for lying-down the human body, a complex system should be provided and programmed through a computer for automatic control dependent upon individual user requirements, thereby increasing the installation investment, operation complexity and maintenance problems.

The present inventor has found the drawbacks of the conventional air mattress and invented the present air mattress for modulating ridden positions.

SUMMARY OF THE INVENTION

The object of the present invention is to provide an air mattress including a plurality of inflatable sacs juxtapositionally connected together in a mattress envelope; an air pump for inflating or deflating the sacs for cushioning a patient ridden thereon; a leg bending device consisting of a plurality of inflatable sacs transversely juxtapositioned at a leg section of the mattress envelope and formed as arcuate shape when inflated for cushioning a patient's bending leg; a body turning device consisting of a plurality of inflatable sacs longitudinally juxtapositioned at a right and left side of a torso section and a head section of the mattress envelope, and alternatively inflated and deflated at the right and left sides for turning the patient's body leftwardly and rightwardly; and a head lifting device consisting of a plurality of inflatable sacs gradually decreasing in height from a patient's head portion to the patient's shoulder or neck portion for cushioning the patient's head, thereby forming an air mattress for ergonomically cushioning different body portions of a patient or person.

DETAILED DESCRIPTION

Figure 1:
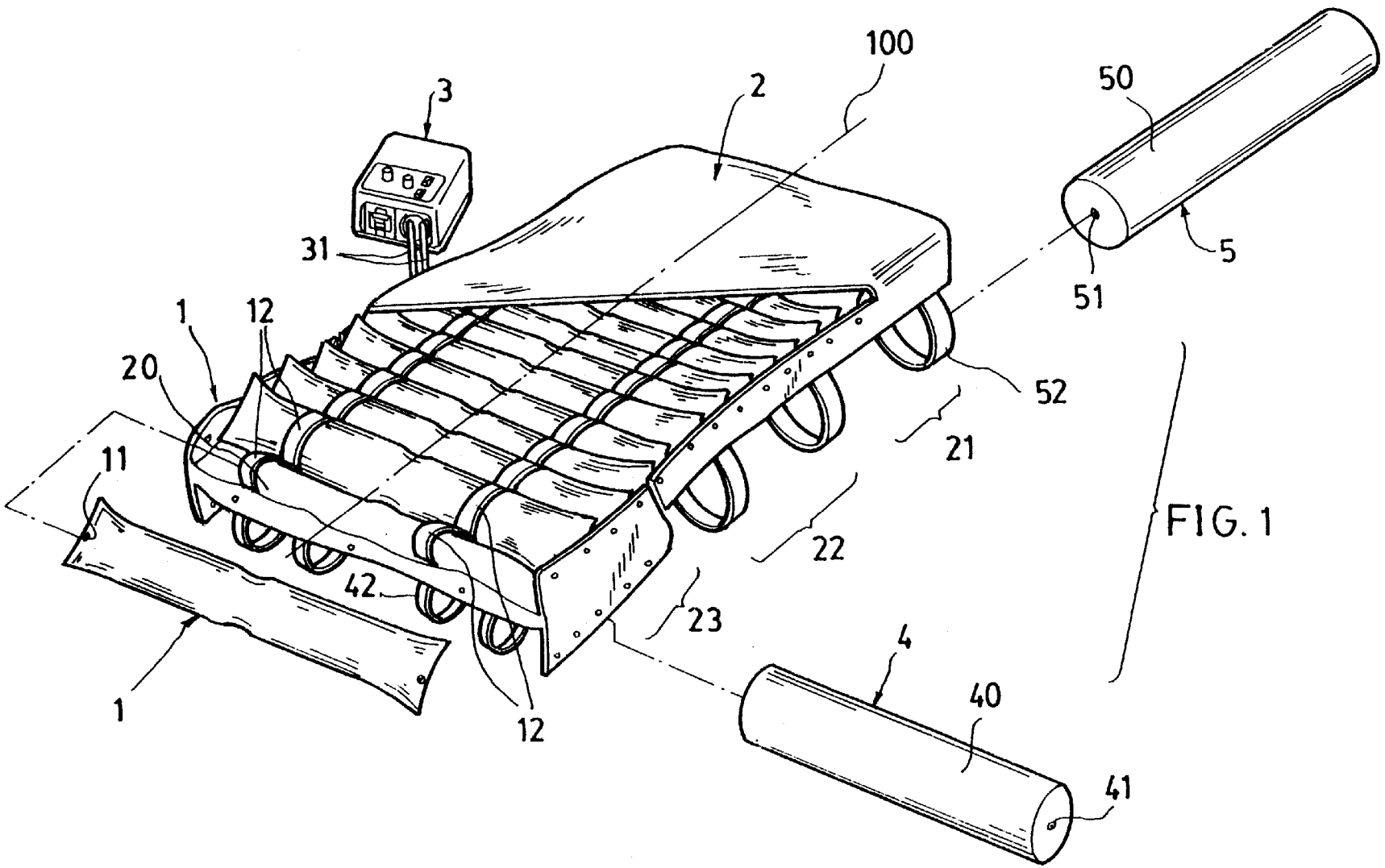
FIG. 1 is a partial exploded view of the present invention.
Figure 2:
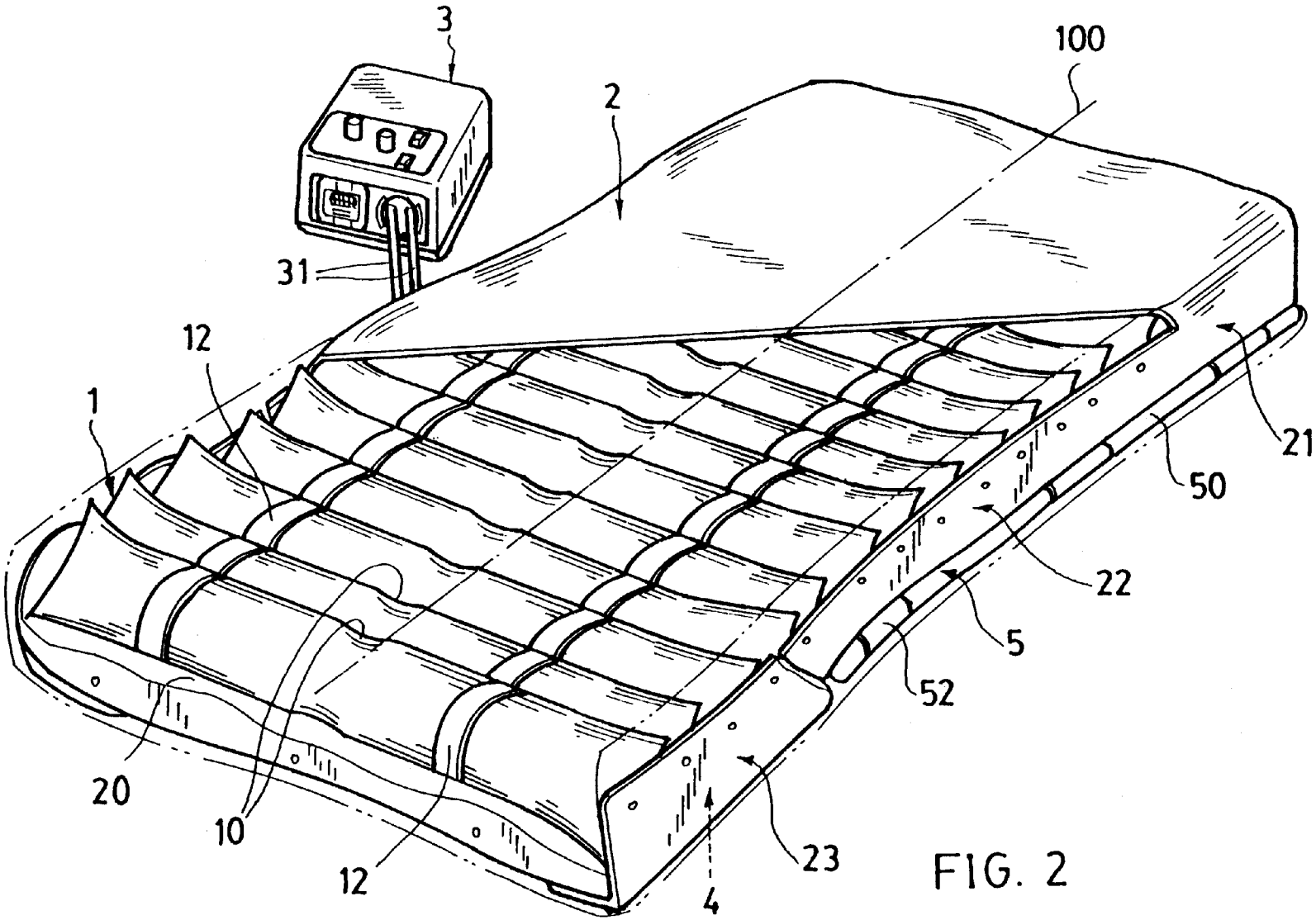
FIG. 2 is an illustration of the present invention when assembled.

As shown in FIGS. 1~8, an air mattress of the present invention comprises: a plurality of inflatable sacs 1 juxtapositionally connected together within a mattress envelope or frame 2 having a head section 21, a torso section 22 and a leg section 23; an air pump 3 for inflating or deflating the sacs 1 through a plurality of hoses 31; a leg bending means 4 provided at the leg section 23 for raising a patient's leg arcuately; a body turning means 5 provided at the torso section 22 and the head section 21 for alternatively turning a patient rightwardly and leftwardly; and a head lifting means 6 provided at the head section 21 for supporting a patient's head.

Each inflatable sac 1 includes a pair of buttons disposed on opposite ends of the sac 1 and engageable with two sockets formed on two side walls of the mattress envelope 2. Each sac 1 is secured on a base 20 of the mattress envelope 2 by a pair of (or plural) fastening belts or straps 12. The belts or straps 12 may be linearly aligned as arranged on the base 20 of the mattress envelope 2 as shown in the drawings.

All the inflatable sacs 1 are transversely juxtapositionally secured on the base 20, each sac 1 fluidically communicated with the air pump 3 and being generally perpendicular to a longitudinal axis 100 defined at a longitudinal center along a length of the air mattress or the mattress envelope 2.

The leg bending means 4 is positioned under the sacs 1 at a leg section 23 of the envelope 2 and includes: a first cushioning sac 40 transversely secured under the base 20 and having a large diameter and inflated for lifting the inflatable sac 1 corresponding to a knee K of a patient ridden on the sacs 1 of the air mattress of the present invention, a pair of second cushioning sacs 40*a* transversely disposed on opposite sides of the first cushioning sac 40 with each sac 40*a* having a medium diameter smaller than that of the first cushioning sac 40 and the two sacs 40*a* respectively corresponding to a thigh T and a shank S of the patient, and a pair of third cushioning sacs 40*b* transversely disposed on opposite sides of the second cushioning sacs 40*a* and respectively corresponding to a buttock and a foot of the patient with each sac 40*b* having a small diameter smaller than that of the second sac 40*a*; each sac 40, 40*a*, 40*b* having a pair of buttons 41 engageably secured to two side walls of the mattress envelope and each sac 40, 40*a*, 40*b* transversely secured to the base 20 of the envelope by at least a fastening belt or strap 42 to be positioned under the inflatable sacs 1 secured to the base 20; and the transverse cushioning sacs 40, 40*a*, 40*b* respectively fluidically communicated with the air pump 3 by hoses, valves and adapters (not shown) and operatively inflated by the pump 3 for supporting the inflatable sacs 1 at the leg section 21 for forming an arcuate shape corresponding to a bending patient's leg convex upwardly (FIGS. 9, 11) for cushioning the patient's leg ergonomically and comfortably.

Figure 3:
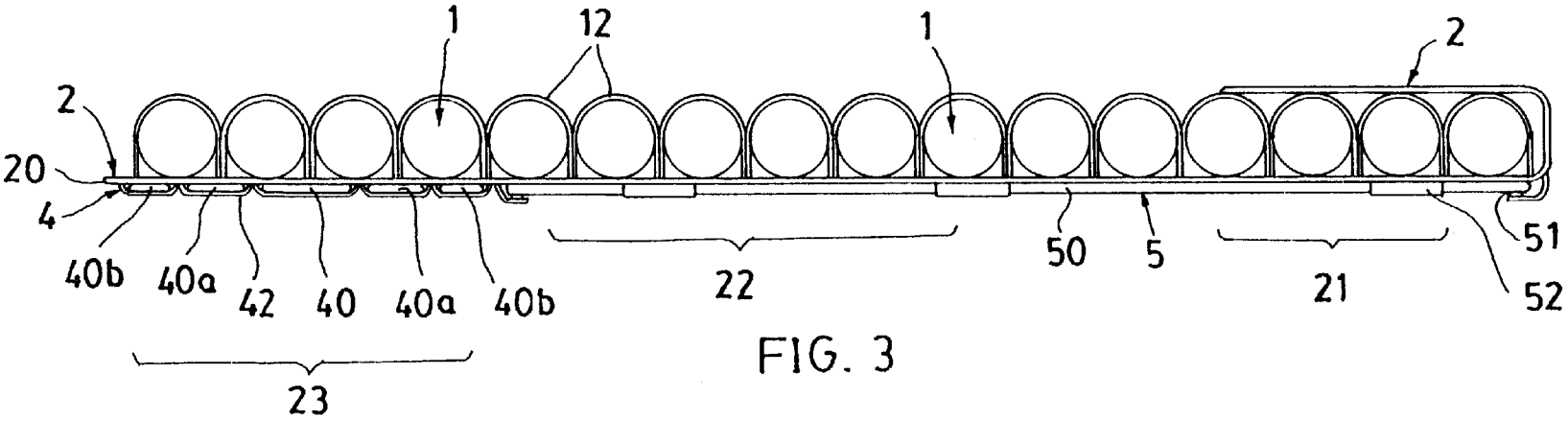
FIG. 3 is a longitudinal elevational drawing of the present invention.
Figure 4:
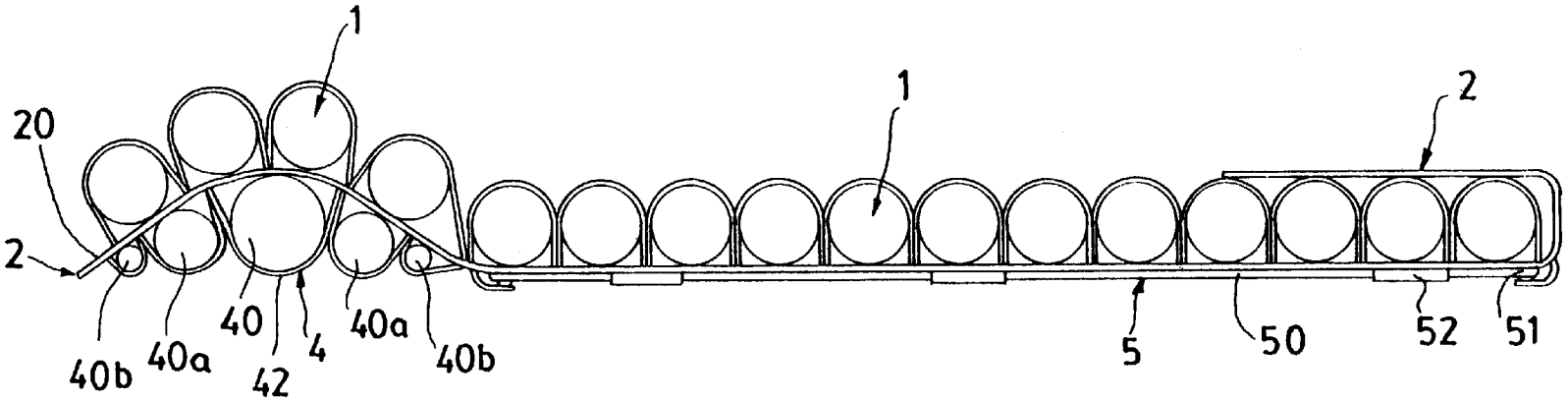
FIG. 4 is an illustration showing an arcuate leg section of the present invention.
Figure 5:
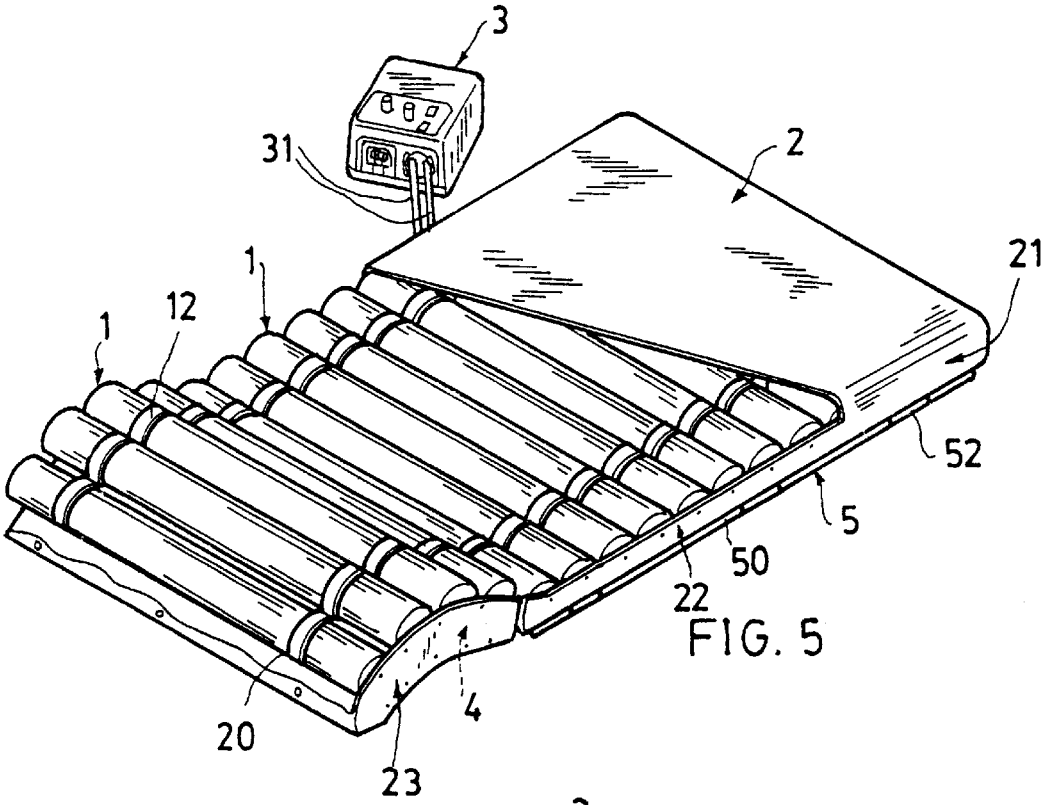
FIG. 5 is a perspective view of the present invention as shown in FIG. 4.

The cushioning sacs 40, 40*a*, 40*b* may be deflated from FIG. 4 to FIG. 3 and then inflated alternatively and repeatedly for exercising the patient's leg for rehabilitation.

Figure 8:
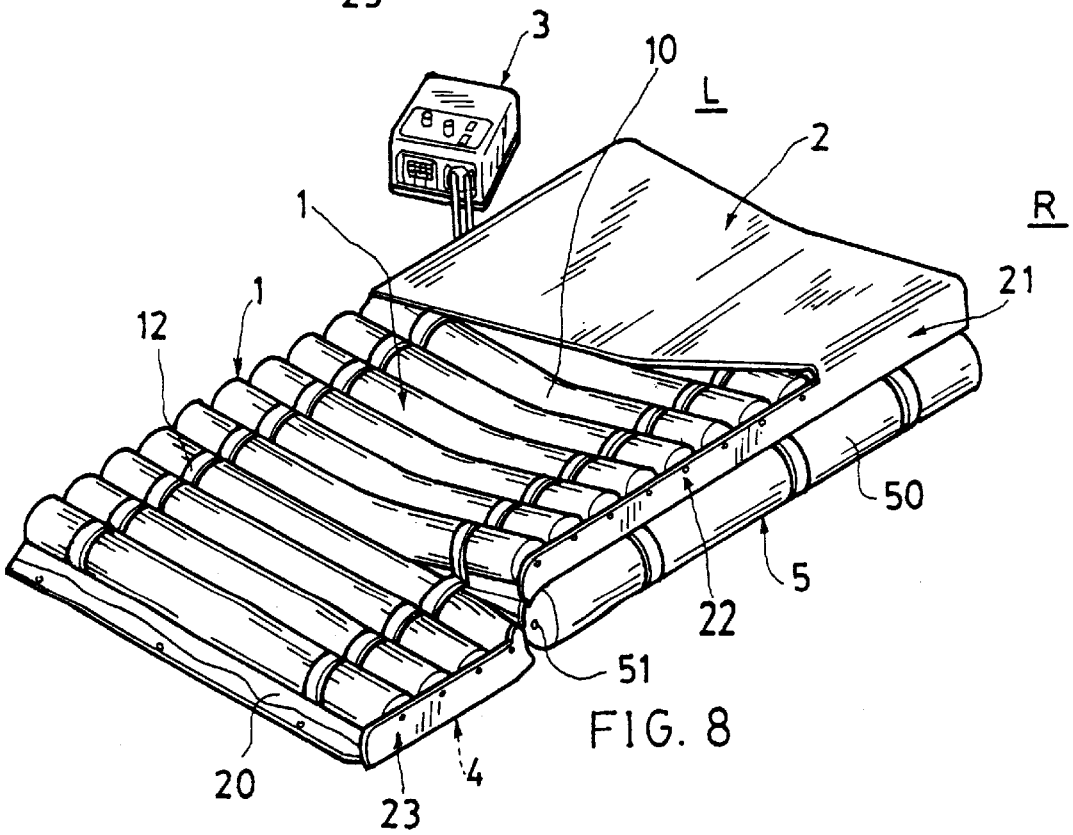
FIG. 8 shows a turned mattress of the present invention when turned from the right side.
Figure 6:
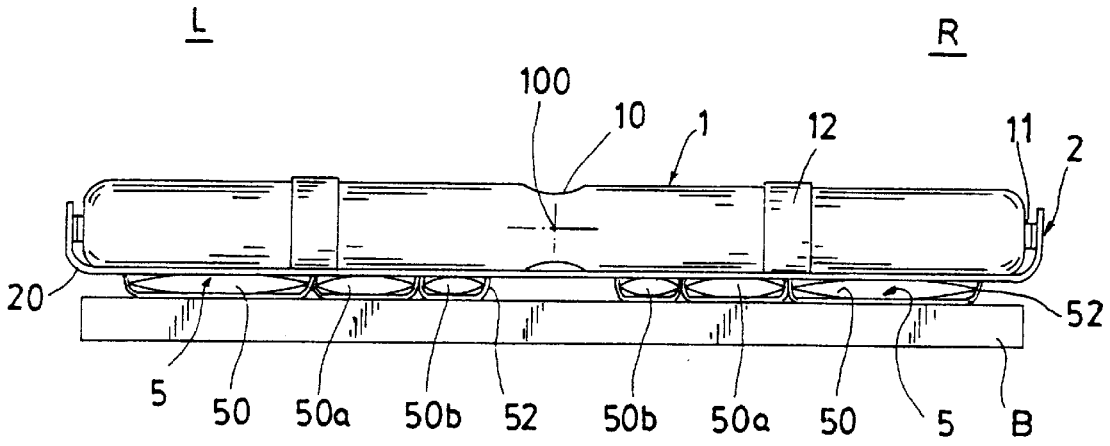
FIG. 6 is a cross sectional drawing of the body turning means of the present invention.
Figure 7:
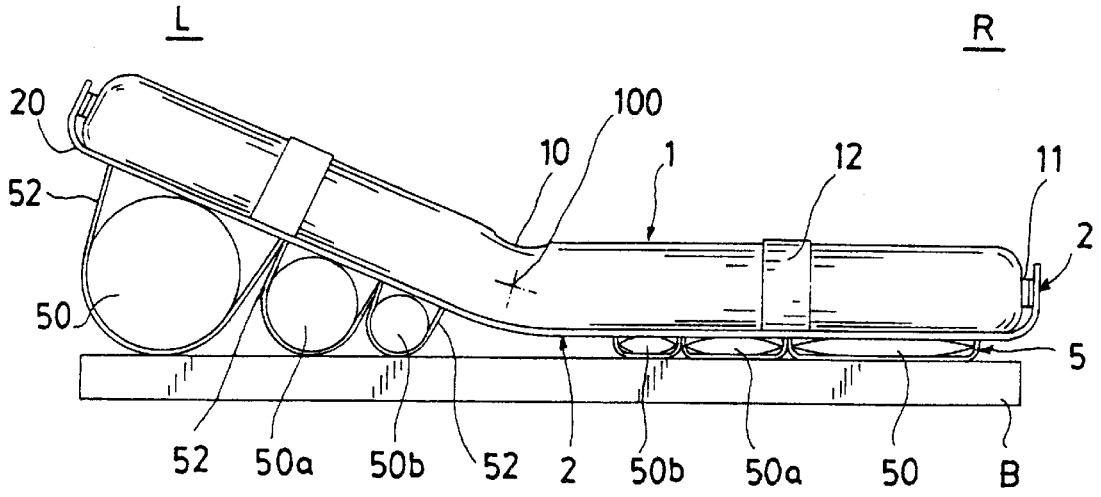
FIG. 7 shows a turned mattress of FIG. 6 when turned from the left side.

The body turning means 5 as shown in FIGS. 6~8 includes: two sets of longitudinal cushioning sacs longitudinally juxtapositioned respectively at a right side R and a left side L of the axis 100 of the air mattress below the base and inflatable sacs 1 of the torso and head sections 22, 21, each set of longitudinal cushioning sacs including a side cushioning sac 50 adjacent to a side wall of the envelope 2 and having a large diameter, an intermediate cushioning sac 50*a* positioned next to the side cushioning sac 50 and having a medium diameter smaller than that of the side sac 50, and an inner cushioning sac 50*b* positioned at an inner side of the intermediate sac 50*a* adjacent to the longitudinal axis 100 having a small diameter smaller than that of the sac 50*a*, thereby forming a plurality of cushioning sacs 50, 50*a*, 50*b* gradually decreasing in diameter from an outer side of the mattress towards the longitudinal axis 100 and forming a slope inclined inwardly from the outside towards the axis 100 when the sacs 50, 50*a*, 50*b* are inflated to thereby turn the patient ridden 1 on the mattress from one side (left side) to the other side (right side), and vice versa for turning the patient rightwardly and leftwardly for preventing bed sores. The narrow portion 10 recessed in each sac 1 helps the bending operation of the sac 1 when turning the mattress.

The air mattress of the present invention may be jacketed in an outer cover or bag for better appearance and then placed on a bed or substrate B. Each cushioning sac 50, 50*a*, 50*b* may also be secured on the base 20 by belts or straps 52 and the sac be fastened to the side wall of the envelope by buttons 51.

Figure 9:
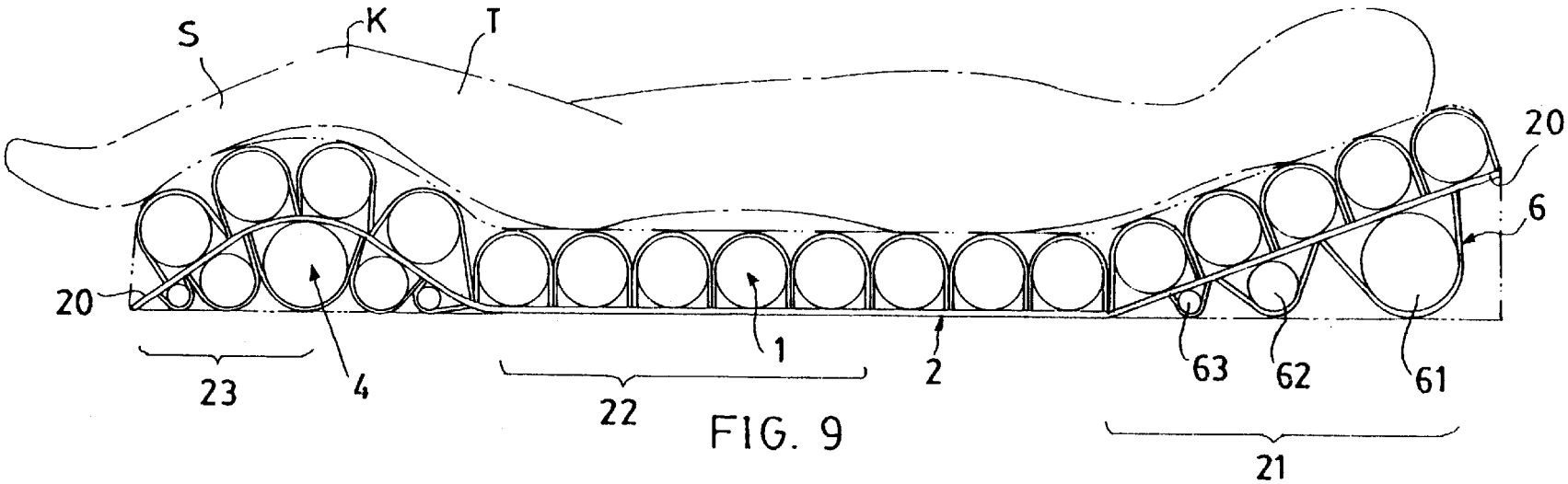
FIG. 9 is an illustration when effected by a head lifting means and a leg bending means in accordance with the present invention.
Figure 10:
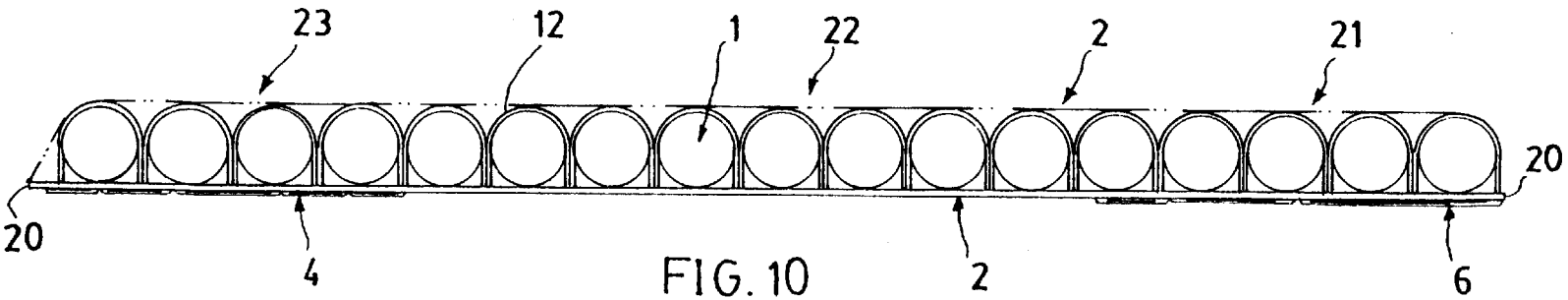
FIG. 10 is an illustration when deflated from FIG. 9.

The head lifting means 6 as shown in FIGS. 9, 10 includes: a plurality of transverse cushioning sacs gradually decreasing their diameter and transversely juxtapositioned under the base 20 and the inflatable sacs 1 at the head section 21 and operatively inflated to form a pillow sloping downwardly from an end portion of the head section 21 towards the torso section 22 for cushioning the patient's head. For instance, a top cushioning sac 61 having a large diameter, a middle sac 62 having a medium diameter and a low cushioning sac 63 having a small diameter are gradually decreasing in diameter and juxtapositioned under the inflatable sacs 1 at the head section 21 for forming a sloping pillow for cushioning the patient's head.

Figure 11:
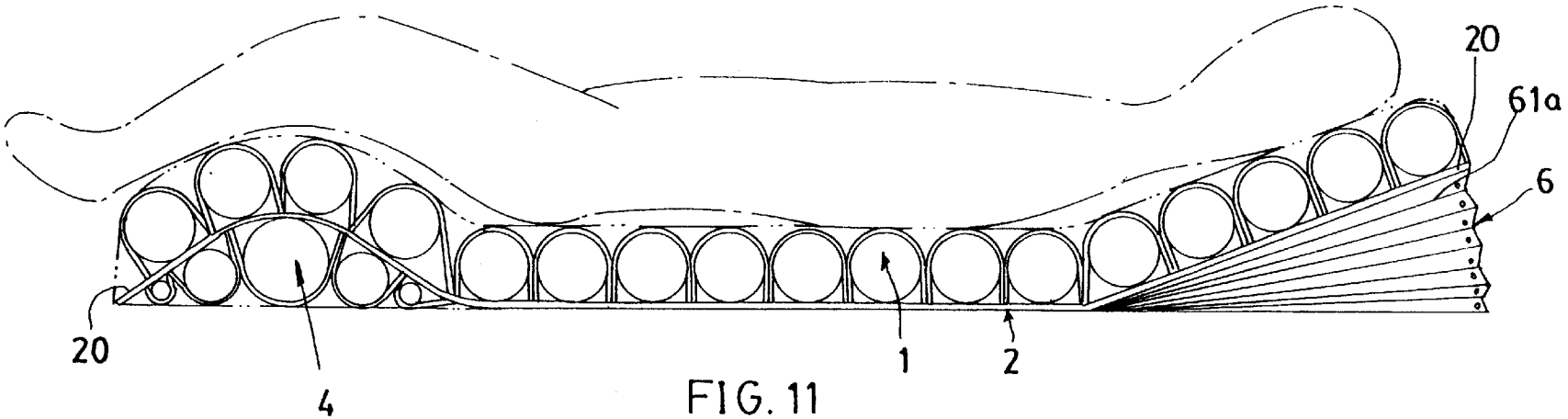
FIG. 11 shows still another preferred embodiment of the present invention having the head portion lifted and the leg portion arcuately bent.
Figure 12:
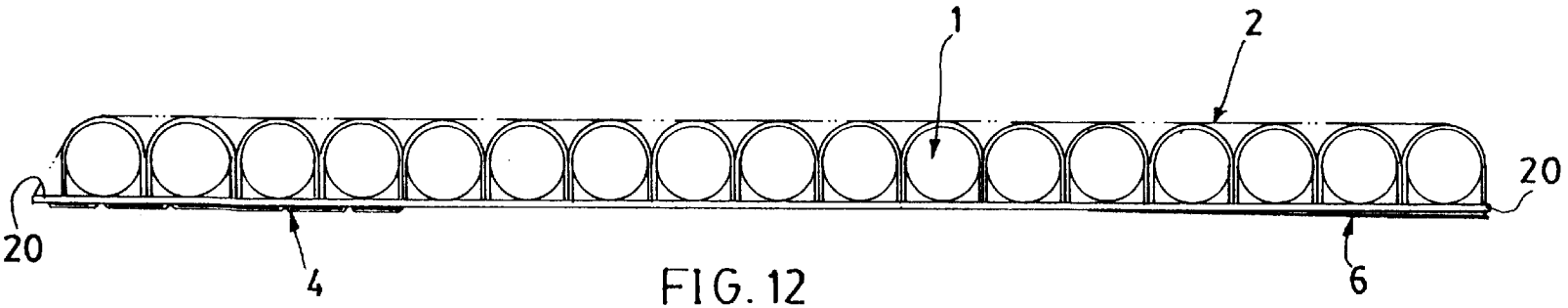
FIG. 12 is an illustration when deflated from FIG. 11.

As shown in FIGS. 11, 12, the head lifting means 6 is modified to be a bellows which is inflated to form a wedge inclined downwardly from an end portion of the head section 21 adjacent to the patient's head towards a torso section 22 for cushioning the patient's head.

Other modifications may be made without departing from the spirit and scope of the present invention.

The present invention is superior to the prior art because a plurality of cushioning sacs having different diameters are provided for well modulating the different riding positions of the patient's body portions with simple devices and low cost, without requiring a complex expensive system as aided by computer hardwares and softwares.

I claim:

1. An air mattress comprising:

a plurality of inflatable sacs juxtapositionally connected together in a mattress envelope defining a longitudinal axis at a longitudinal center along a length of the mattress envelope and having a head section, a torso section and a leg section corresponding to a head, a torso and a leg of a patient or person ridden on the inflatable sacs secured on a base of said mattress envelope, each said inflatable sac having a narrow portion recessed in a middle portion of said sac;

an air pump fluidically communicated with said inflatable sacs for inflating or deflating said inflatable sacs; and a body turning means including: two sets of longitudinal cushioning sacs longitudinally juxtapositioned respectively at a right side and a left side of the axis of the air mattress below the base and inflatable sacs at the torso and head sections, each said set of longitudinal cushioning sacs including a side cushioning sac adjacent to a side wall of the envelope and having a diameter, an intermediate cushioning sac positioned adjacent the side cushioning sac and having a diameter smaller than that of the side cushioning sac, and an inner cushioning sac positioned at an inner side of and adjacent the intermediate cushioning sac and adjacent to the longitudinal axis and having a diameter smaller than that of the intermediate cushioning sac, thereby forming a plurality of longitudinal cushioning sacs gradually decreasing in diameter from an outer side of the mattress towards the longitudinal axis and forming a slope inclined inwardly from the outside towards the longitudinal axis, whereby upon alternative inflation and deflation of either set of said longitudinal cushioning sacs, the patient ridden on the mattress will be turned from one side to the other side for turning the patient rightwardly and leftwardly for preventing bed sores.

* * * * *